US008727704B2

(12) United States Patent
Lee et al.

(10) Patent No.: US 8,727,704 B2
(45) Date of Patent: May 20, 2014

(54) RING SEGMENT WITH SERPENTINE COOLING PASSAGES

(75) Inventors: Ching-Pang Lee, Cincinnati, OH (US); Eric C. Berrong, Charlotte, NC (US)

(73) Assignee: Siemens Energy, Inc., Orlando, FL (US)

( * ) Notice: Subject to any disclaimer, the term of this patent is extended or adjusted under 35 U.S.C. 154(b) by 398 days.

(21) Appl. No.: 13/213,417

(22) Filed: Aug. 19, 2011

(65) Prior Publication Data

US 2012/0057968 A1 Mar. 8, 2012

Related U.S. Application Data

(60) Provisional application No. 61/380,450, filed on Sep. 7, 2010.

(51) Int. Cl.
*F01D 11/08* (2006.01)

(52) U.S. Cl.
USPC ..... 415/116; 415/173.1; 415/176; 415/178

(58) Field of Classification Search
USPC ..... 415/115, 116, 173.1, 173.2, 175–178
See application file for complete search history.

(56) References Cited

U.S. PATENT DOCUMENTS

| | | | | |
|---|---|---|---|---|
| 3,728,039 | A | 4/1973 | Plemmons et al. | |
| 3,825,364 | A | 7/1974 | Halila et al. | |
| 3,849,025 | A | 11/1974 | Grondahl | |
| 4,497,610 | A | 2/1985 | Richardson et al. | |
| 4,526,226 | A * | 7/1985 | Hsia et al. | 415/116 |
| 4,573,865 | A | 3/1986 | Hsia et al. | |
| 4,679,981 | A | 7/1987 | Guibert et al. | |
| 4,752,184 | A | 6/1988 | Liang | |
| 5,169,287 | A | 12/1992 | Proctor et al. | |
| 5,374,161 | A | 12/1994 | Kelch et al. | |
| 5,375,973 | A | 12/1994 | Sloop et al. | |
| 5,380,150 | A | 1/1995 | Stahl | |
| 5,486,090 | A | 1/1996 | Thompson et al. | |
| 5,538,393 | A | 7/1996 | Thompson et al. | |
| 6,017,189 | A | 1/2000 | Judet et al. | |
| 6,155,778 | A | 12/2000 | Lee et al. | |
| 7,033,138 | B2 | 4/2006 | Tomita et al. | |
| 7,246,993 | B2 | 7/2007 | Bolms et al. | |
| 7,284,954 | B2 | 10/2007 | Parker et al. | |
| 7,665,962 | B1 | 2/2010 | Liang | |
| 7,670,108 | B2 | 3/2010 | Liang | |
| 2004/0120803 | A1 * | 6/2004 | Lucas et al. | 415/116 |
| 2004/0146399 | A1 | 7/2004 | Bolms | |
| 2005/0058534 | A1 * | 3/2005 | Lee et al. | 415/116 |
| 2007/0041827 | A1 | 2/2007 | Camus | |
| 2011/0044805 | A1 * | 2/2011 | Koyabu et al. | 415/177 |

FOREIGN PATENT DOCUMENTS

| | | | |
|---|---|---|---|
| EP | 0694677 | A1 | 1/1996 |
| EP | 1517008 | A2 | 3/2005 |

* cited by examiner

*Primary Examiner* — Christopher Verdier

(57) ABSTRACT

A ring segment for a gas turbine engine includes a panel and a cooling system. The cooling system receives cooling fluid from an outer side of the panel for cooling the panel and includes at least one cooling fluid supply passage, at least one serpentine cooling passage, and at least one cooling fluid discharge passage. The cooling fluid supply passage(s) receive the cooling fluid from the outer side of the panel and deliver the cooling fluid to a first cooling fluid chamber within the panel. The serpentine cooling passage(s) receive the cooling fluid from the first cooling fluid chamber, wherein the cooling fluid provides convective cooling to the panel as it passes through the serpentine cooling passage(s). The cooling fluid discharge passage(s) discharge the cooling fluid from the cooling system.

20 Claims, 2 Drawing Sheets

RING SEGMENT WITH SERPENTINE COOLING PASSAGES

CROSS REFERENCE TO RELATED APPLICATIONS

This application claims the benefit of U.S. patent application Ser. No. 61/380,450, filed Sep. 7, 2010, entitled "SERPENTINE COOLED RING SEGMENT," the entire disclosure of which is incorporated by reference herein.

FIELD OF THE INVENTION

The present invention relates to ring segments for gas turbine engines and, more particularly, to cooling of ring segments in gas turbine engines.

BACKGROUND OF THE INVENTION

It is known that the maximum power output of a combustion turbine is achieved by heating the gas flowing through the combustion section to as high a temperature as is feasible. The hot gas, however, heats the various turbine components, such as airfoils and ring segments, which it passes when flowing through the turbine section. One aspect limiting the ability to increase the combustion firing temperature is the ability of the turbine components to withstand increased temperatures. Consequently, various cooling methods have been developed to cool turbine hot parts.

In the case of ring segments, ring segments typically may include an impingement tube, also known as an impingement plate, associated with the ring segment and defining a plenum between the impingement tube and the ring segment. The impingement tube may include holes for passage of cooling fluid into the plenum, wherein cooling fluid passing through the holes in the impingement tube may impinge on the outer surface of the ring segment to provide impingement cooling to the ring segment. In addition, further cooling structure, such as internal cooling passages, may be formed in the ring segment to facilitate cooling thereof.

SUMMARY OF THE INVENTION

In accordance with a first aspect of the invention, a ring segment is provided for a gas turbine engine. The ring segment comprises a panel and a cooling system. The panel includes a leading edge, a trailing edge, a first mating edge, a second mating edge, an outer side, and an inner side. Cooling fluid is provided to the outer side and the inner side defines at least a portion of a hot gas flow path through the gas turbine engine. The cooling system is located within that panel and receives cooling fluid from the outer side of the panel for cooling the panel. The cooling system comprises at least one cooling fluid supply passage, at least one serpentine cooling passage, and at least one cooling fluid discharge passage. The cooling fluid supply passage(s) receive the cooling fluid from the outer side of the panel and deliver the cooling fluid to a first cooling fluid chamber within the panel. The serpentine cooling passage(s) receive the cooling fluid from the first cooling fluid chamber, wherein the cooling fluid provides convective cooling to the panel as it passes through the serpentine cooling passage(s). The cooling fluid discharge passage(s) discharge the cooling fluid from the cooling system.

In accordance with a second aspect of the invention, a ring segment is provided for a gas turbine engine. The ring segment comprises a panel and a cooling system. The panel includes a leading edge, a trailing edge, a first mating edge, a second mating edge, an outer side, and an inner side. Cooling fluid is provided to the outer side and the inner side defines at least a portion of a hot gas flow path through the gas turbine engine. The cooling system is located within the panel and receives cooling fluid from the outer side of the panel for cooling the panel. The cooling system comprises at least one serpentine cooling passage that receives the cooling fluid from the outer side of the panel. The cooling fluid provides convective cooling to the panel as it passes through the serpentine cooling passage(s). The serpentine cooling passage (s) comprise at least two turns of about 180 degrees, the turns being configured such that the cooling fluid passing through the serpentine cooling passage(s) flows generally axially toward the trailing edge, turns about 180 degrees and flows generally axially toward the leading edge, and again turns about 180 degrees and flows generally axially toward the trailing edge. The cooling system further comprises at least one cooling fluid discharge passage that discharges the cooling fluid from the cooling system.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
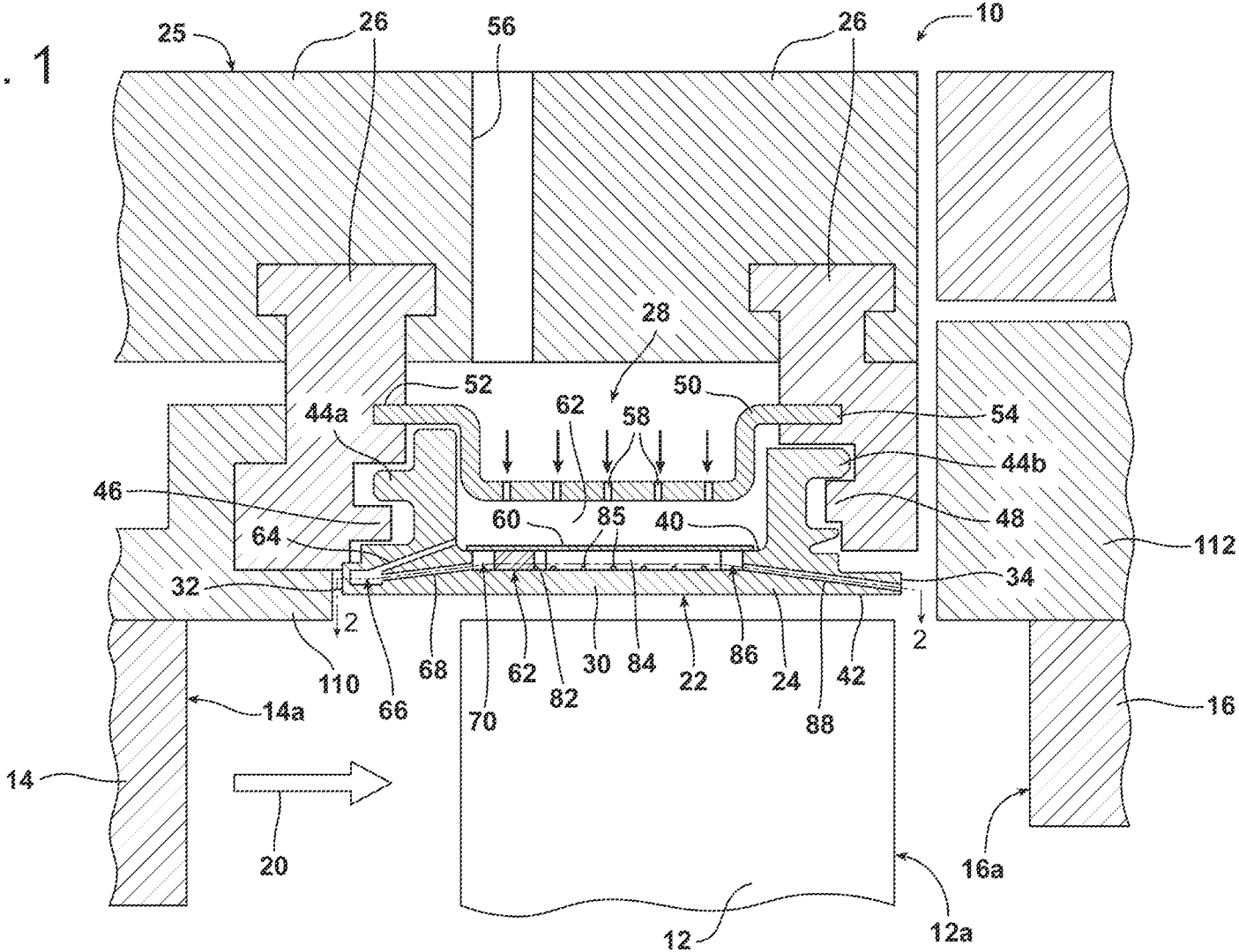
FIG. 1 is cross sectional view of a portion of a turbine section of a gas turbine engine, including a ring segment constructed in accordance with the present invention.

FIG. 1 illustrates a portion of a turbine section 10 of a gas turbine engine. Within the turbine section 10 are alternating rows of stationary vanes and rotating blades. In FIG. 1, a single blade 12 forming a row 12*a* of blades is illustrated. Also illustrated in FIG. 1 are part of an upstream vane 14 forming a row 14*a* of upstream vanes, and part of a downstream vane 16 forming a row 16*a* of downstream vanes. The blades 12 are coupled to a disc (not shown) of a rotor assembly. A hot working gas from a combustor (not shown) in the engine flows in a hot gas flow path 20 passing through the turbine section 10. The working gas expands through the turbine 10 as it flows through the hot gas flow path 20 and causes the blades 12, and therefore the rotor assembly, to rotate.

In accordance with an aspect of the invention, an outer seal structure 22 is provided about and adjacent the row 12*a* of blades. The seal structure 22 comprises a plurality of ring segments 24, which, when positioned side by side in a circumferential direction, define the seal structure 22. The seal structure 22 has a ring shape so as to extend circumferentially about its corresponding row 12*a* of blades. A corresponding one of the seal structures 22 may be provided about each row of blades provided in the turbine section 10.

The seal structure 22 comprises an inner wall of a turbine housing 25 in which the rotating blade rows are provided and defines sealing structure for preventing or limiting the working gas from passing through the inner wall and reaching other structure of the turbine housing, such as a blade ring carrier 26 and an associated annular cooling fluid plenum 28. It is noted that the terms "inner", "outer", "radial", "axial", "circumferential", and the like, as used herein, are not intended to be limiting with regard to orientation of the elements recited for the present invention.

Figure 2:
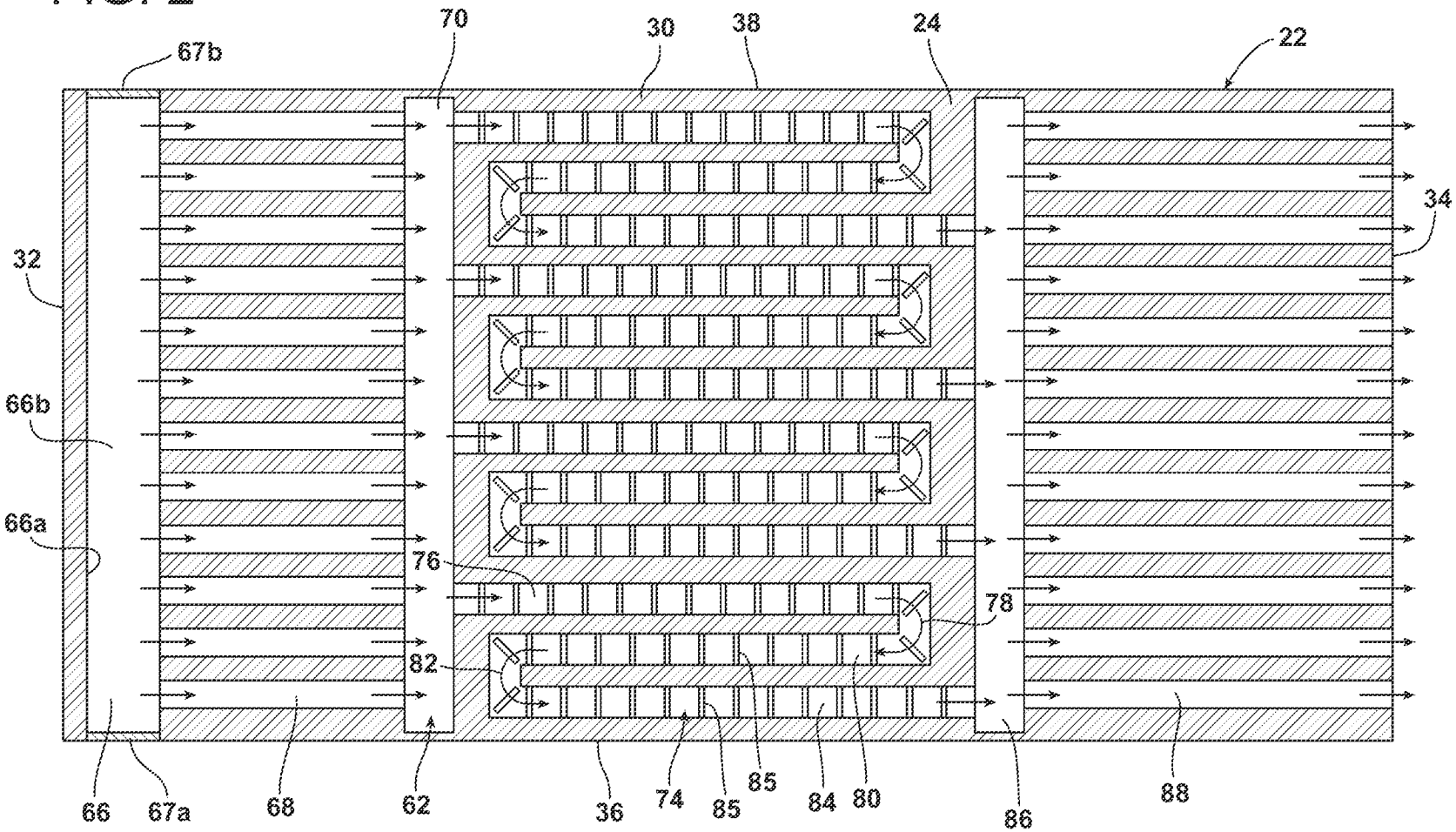
FIG. 2 is a cross sectional view taken along line 2-2 in FIG. 1.

Referring to FIGS. 1 and 2, a single one of the ring segments 24 of the seal structure 22 is shown, it being understood that the other ring segments 24 of the seal structure 22 are generally identical to the single ring segment 24 shown and described. The ring segment 24 comprises a panel 30 including side edges comprising a leading edge 32, a trailing edge 34, a first mating edge 36 (see FIG. 2), and a second mating edge 38 (see FIG. 2). The panel 30 further includes an outer side 40 (see FIG. 1) and an inner side 42 (see FIG. 1), wherein the inner side 42 defines a corresponding portion of the hot gas flow path 20.

The panel 30 defines a structural body for the ring segment 24, and includes one or more front flanges or hook members 44*a* and one or more rear flanges or hook members 44*b*, see FIG. 1. The front and rear hook members 44*a*, 44*b* are rigidly attached to the panel 30, and may be formed with the panel 30 as an integral casting, or may be formed separately and subsequently rigidly attached to the panel 30. Moreover, if formed separately from the panel 30 the hook members 44*a*, 44*b* may be formed of the same material or a different material than the panel 30. Each ring segment 24 is mounted within the turbine section 10 via the front hook members 44*a* engaging a corresponding structure 46 of the blade ring carrier 26, and the rear hook members 44*b* engaging a corresponding structure 48 of the blade ring carrier 26, as seen in FIG. 1.

Referring to FIG. 1, the blade ring carrier 26 defines, in cooperation with an impingement tube 50, also known as an impingement plate, the annular cooling fluid plenum 28, which defines a source of cooling fluid for the seal structure 22, as is described further below. The impingement tube 50 is secured to the blade carrier ring 26 at fore and aft locations 52, 54, as shown in FIG. 1. The cooling fluid plenum 28 receives cooling fluid through a channel 56 formed in the blade ring carrier 26 from a source of cooling fluid, such as bleed air from a compressor (not shown) of the gas turbine engine. As shown in FIG. 1, the impingement tube 50 includes a plurality of impingement holes 58 therein. Cooling fluid in the cooling fluid plenum 28 flows through the impingement holes 58 in the impingement tube 50 and impinges on the outer side 40 of the panel 30 during operation, as will be discussed herein.

Referring to FIG. 1, the outer side 40 of the illustrated panel 30 may include a cover plate 60 that is secured to a remaining portion of the panel 30, such as, for example, by welding. The cover plate 60 is used to enclose a portion of a cooling system 62 provided within the panel 30.

The cooling system 62 is located within the panel 30 and receives cooling fluid from the outer side 40 of the panel 30 via a plurality of leading edge cooling fluid supply passages 64, see FIG. 1. As shown in FIG. 1, the cooling fluid supply passages 64 may be angled in a radially inward direction such that the cooling fluid entering the cooling fluid supply passages 64 is able to approach the inner side 42 of the panel 30.

The cooling fluid supply passages 64 deliver the cooling fluid to a first cooling fluid chamber 66 located in the panel 30 near the leading edge 32 and near the inner side 42, see FIGS. 1 and 2. The cooling fluid flowing into the first cooling fluid chamber 66 provides impingement cooling to the panel 30 and also provides convective cooling to the panel 30. That is, the cooling fluid entering the first cooling fluid chamber 66 impinges on walls 66*a*, 66*b* (see FIG. 2) of the panel 30 that define the first cooling fluid chamber 66 as the cooling fluid enters the first cooling fluid chamber 66. The cooling fluid further provides convective cooling for the panel 30 while flowing within the first cooling fluid chamber 66. The first cooling fluid chamber 66 extends between the first and second mating edges 36, 38 of the panel 30 and is sealed at opposed circumferential ends by first and second weld plugs 67*a*, 67*b* (see FIG. 2), although other suitable methods for sealing the first cooling fluid chamber 66 could be used as desired or the first cooling fluid chamber 66 could be formed as an enclosed chamber, e.g., with the use of a sacrificial ceramic core.

A plurality of transitional cooling fluid passages 68 deliver the cooling fluid from the first cooling fluid chamber 66 to a second cooling fluid chamber 70. The cooling fluid passing through the transitional cooling fluid passages 68 provides convective cooling to the panel 30 as it flows within the transitional cooling fluid passages 68. The number and size of the transitional cooling fluid passages 68 can be selected to fine tune cooling to the panel 30, e.g., a plurality of evenly spaced apart transitional cooling fluid passages 68 located close to the inner side 42 of the panel 30 may be provided to provide an even amount of cooling to the inner side 42 of the panel 30 with respect to a circumferential direction of the engine.

The cooling fluid provides convective cooling to the panel 30 as it flows within the second cooling fluid chamber 70. The second cooling fluid chamber 70 extends between the first and second mating edges 36, 38 and can be either cast or machined into the panel 30 and then sealed with the cover plate 60, although other suitable methods for forming and sealing the second cooling fluid chamber 70 could be used as desired, such as with the use of a sacrificial ceramic core.

The second cooling fluid chamber 70 delivers the cooling fluid to one or more serpentine cooling passages 74, illustrated in FIG. 2 as four serpentine cooling passages 74 but additional or fewer serpentine cooling passages 74 could be provided in the panel 30. The cooling fluid provides convective cooling to the panel 30 as it flows within the sections of the serpentine cooling passages 74. In the embodiment shown, the cooling fluid flows generally axially through a first pass 76 of each serpentine cooling passage 74 toward the trailing edge 34 of the panel 30. Upon reaching a first turn 78 of each serpentine cooling passage 74, located adjacent to a third cooling fluid chamber 86, the fluid is redirected about 180 degrees in the circumferential direction. The cooling fluid then flows generally axially through a second pass 80 of each serpentine cooling passage 74 toward the leading edge 32 of the panel 30. Upon reaching a second turn 82 of each serpentine cooling passage 74, located adjacent to the second cooling fluid chamber 70, the fluid is again redirected about 180 degrees in the circumferential direction. The cooling fluid then flows generally axially through a third pass 84 of each serpentine cooling passage 74 toward the trailing edge 34 of the panel 30.

As shown in FIG. 2, the serpentine cooling passages 74 are configured such that the axially extending passes 76, 80, 84 are located circumferentially adjacent to each other, i.e., the passes 76, 80, 84 are generally parallel to one another, at substantially the same radial location. Hence, the cooling fluid flowing through each pass 76, 80, 84 flows circumferentially adjacent to the adjacent passes 76, 80, 84. The serpentine cooling passages 74 may be cast with the panel 30, e.g., with a sacrificial ceramic core, or may be machined in the panel 30 and enclosed with a cover plate 60, as shown in FIG. 2.

As an optional feature and as illustrated in the embodiment shown in FIGS. 1 and 2, each serpentine cooling passage 74 may include turbulator ribs 85 along the wall of the passages 74 nearest to the inner side 42 of the panel 30. The turbulator ribs 85 effect an increase in cooling provided by the cooling fluid by providing a turbulated flow of cooling fluid and by increasing the surface area of the corresponding wall.

After passing through the third pass 84 of the serpentine cooling passages 74, the cooling fluid exits the serpentine cooling passages 74 and flows into the third cooling fluid chamber 86. The cooling fluid provides convective cooling to the panel 30 as it flows within the third cooling fluid chamber 86. The third cooling fluid chamber 86 extends between the first and second mating edges 36, 38 and can be either cast or machined into the panel 30 and then sealed with the cover plate 60, although other suitable methods for forming and sealing the third cooling fluid chamber 86 could be used as desired, such as with the use of a sacrificial ceramic core.

The third cooling fluid chamber 86 delivers the cooling fluid to a series of cooling fluid discharge passages 88. The cooling fluid provides convective cooling to the panel 30 as it flows within the cooling fluid discharge passages 88 and is then discharged from the panel 30, wherein the cooling fluid is then mixed with the hot working gas flowing through the hot gas flow path 20. The number and size of the cooling fluid discharge passages 88 can be selected to fine tune cooling to the panel 30, e.g., a plurality of evenly spaced apart cooling fluid discharge passages 88 located close to the inner side 42 of the panel 30 may be provided to provide an even amount of cooling to the inner side 42 of the panel 30 with respect to the circumferential direction of the engine.

During operation of the engine, cooling fluid is supplied to the cooling fluid plenum 28 via the channel 56 formed in the blade ring carrier 26. The cooling fluid in the cooling fluid plenum 28 flows through the impingement holes 58 in the impingement tube 50 and impinges on the outer side 40 of the panel 30 to provide impingement cooling to the outer side 40 of the panel 30. Portions of this cooling fluid pass into the cooling system 62 of each ring segment 24 through the leading edge cooling fluid supply passages 64. The cooling fluid provides cooling to the panel 30 of each ring segment 24 as discussed above and is then discharged into the hot gas path 20 by the cooling fluid discharge passages 88.

The portion of the ring segment 24 cooled by the passages 64, 68 and the first cooling fluid chamber 66 may substantially comprise a portion of the panel 30 extending from the front hook members 44*a* axially forwardly to the leading edge 32. The portion of the ring segment 24 cooled by the serpentine passages 74 and the second and third cooling fluid chambers 70, 86 may substantially comprise a portion of the panel 30 extending between the front and rear hook members 44*a*, 44*b*. The portion of the ring segment 24 cooled by the passages 88 may substantially comprise a portion of the panel 30 extending from the rear hook members 44*b* to the trailing edge 34.

It is believed that the present configuration for the ring segments 24 provides an efficient cooling of the panels 30 via the impingement and convective cooling provided by the cooling fluid passing through the respective cooling systems 62. Such efficient cooling of the ring segments 24 is believed to result in a lower cooling fluid requirement than prior art ring segments. Hence, enhanced cooling may be provided within the ring segments 24 while minimizing the volume of cooling fluid discharged from the ring segments 24 into the hot working gas, thus resulting in an associated improvement in engine efficiency, i.e., since a lesser amount of cooling fluid is mixed into the hot gas path 20, aerodynamic mixing losses of the hot working gas are reduced. Further, the distributed cooling provided to the panels 30 with the cooling systems 62 is believed to improve the uniformity of temperature distribution across the ring segments 24, i.e., a reduction in a temperature gradient throughout the panel 30, and reduction in thermal stress, resulting in an improved or extended life of the ring segments 24. Additionally, since all the cooling fluid provided into the cooling systems 62 enters near the leading edge 32 of the panel 30, adequate cooling is provided to the leading edge 32 of the panel 32.

Moreover, since the cooling system 62 in each ring segment 24 is provided with the first, second, and third cooling fluid chambers 66, 70, 86, different numbers of leading edge cooling fluid supply passages 64, transitional cooling fluid passages 68, serpentine cooling passages 74, and cooling fluid discharge passages 88 may be provided. Hence, cooling to the various areas of the panel 30 can be fine tuned as desired. For example, if a region of the panel 30 requires a large amount of cooling, a sufficient number and/or size of cooling fluid passages can be provided to remove a greater amount heat from the panel 30 in this region. As another example, if another region of the panel 30 does not require as much cooling, the number and/or size of cooling fluid passages can be provided to remove a lesser amount heat from the panel 30 in this region, i.e., so as to conserve the temperature of the cooling fluid so more cooling can be provided to other downstream locations.

Finally, the number of serpentine cooling passages 74 and the number of turns in each serpentine cooling passage 74 may be selected to fine tune cooling to the panel 30. For example, using fewer serpentine cooling passages 74 with more turns may result in the cooling fluid exiting the serpentine cooling passages 74 with a higher temperature, since that portion of cooling fluid would have covered more surface area as it passes through additional passes of the serpentine cooling passages 74. Alternatively, using more serpentine cooling passages 74 with less turns may result in the cooling fluid exiting the serpentine cooling passages 74 with a lower temperature, since that portion of cooling fluid would have covered less surface area as it passes through additional passes of the serpentine cooling passages 74. However, using too many serpentine cooling passages 74 may result in additional cooling fluid being required to cool the panel 30. Hence, a proper balance of serpentine cooling passages 74 and turns therein should be provided in each panel 30.

While the embodiment of the invention illustrated in FIGS. 1 and 2 includes the various chambers and passages, it is noted that the serpentine cooling passages 74 disclosed herein could be used in combination with additional/fewer passages and chambers. For example, the first cooling fluid chamber 66 could deliver the cooling fluid directly to the serpentine cooling passages 74, i.e., without the use of the transitional cooling fluid passages 68 and the second cooling fluid chamber 70. As another example, the serpentine cooling passages 74 could directly discharge the cooling fluid from the panel 30 into the hot gas flow path 20, i.e., without the third cooling fluid chamber 86, wherein the serpentine cooling passages 74 could function as cooling fluid discharge passages. Many other configurations of the cooling system 62 with the serpentine cooling passages 74 are contemplated, such that the invention is not intended to be limited to the configuration shown in FIGS. 1 and 2.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A ring segment for a gas turbine engine comprising:

a panel having a leading edge, a trailing edge, a first mating edge, a second mating edge, an outer side, and an inner side, wherein cooling fluid is provided to the outer side and the inner side defines at least a portion of a hot gas flow path through the gas turbine engine;

a cooling system within the panel that receives cooling fluid from the outer side of the panel for cooling the panel, the cooling system comprising:

at least one cooling fluid supply passage within the panel that receives the cooling fluid from the outer side of the panel and delivers the cooling fluid to a first cooling fluid chamber within the panel;

at least one serpentine cooling passage that receives the cooling fluid from the first cooling fluid chamber, the cooling fluid providing convective cooling to the panel as it passes through the at least one serpentine cooling passage;

a plurality of transitional cooling fluid passages that receive the cooling fluid from the first cooling fluid chamber and discharge the cooling fluid toward the at least one serpentine cooling passage; and at least one cooling fluid discharge passage that discharges the cooling fluid from the cooling system.

2. The ring segment of claim 1, further comprising a second cooling fluid chamber extending circumferentially within the panel, wherein the second cooling fluid chamber receives the cooling fluid from each of the transitional cooling fluid passages and delivers the cooling fluid to the at least one serpentine cooling passage.

3. The ring segment of claim 2, further comprising a third cooling fluid chamber extending circumferentially within the panel, wherein the third cooling fluid chamber receives the cooling fluid from the at least one serpentine cooling passage and delivers the cooling fluid to the at least one cooling fluid discharge passage.

4. The ring segment of claim 3, wherein the at least one cooling fluid supply passage comprises a plurality of cooling fluid supply passages entirely located within the panel and the at least one cooling fluid discharge passage comprises a plurality of cooling fluid discharge passages.

5. The ring segment of claim 1, wherein the at least one serpentine cooling passage comprises at least two turns of about 180 degrees.

6. The ring segment of claim 5, wherein the turns are configured such that the cooling fluid passing through the at least one serpentine cooling passage flows generally axially toward the trailing edge, turns about 180 degrees and flows generally axially toward the leading edge, and again turns about 180 degrees and flows generally axially toward the trailing edge.

7. The ring segment of claim 6, wherein the at least one serpentine cooling passage is configured such that axially extending portions thereof are located circumferentially adjacent to each other at substantially the same radial location.

8. The ring segment of claim 5, wherein the at least one serpentine cooling passage comprises a plurality of serpentine cooling passages.

9. The ring segment of claim 1, wherein the first cooling fluid chamber extends within the panel from the first mating edge to the second mating edge.

10. The ring segment of claim 1, wherein the first cooling fluid chamber is located in the panel near the leading edge.

11. The ring segment of claim 1, further comprising a plurality of turbulator ribs located in the at least one serpentine cooling passage, the turbulator ribs turbulating the cooling fluid as it passes through the at least one serpentine cooling passage.

12. The ring segment of claim 1, wherein the at least one serpentine cooling passage is located at the same radial location as a portion of the at least one cooling fluid supply passage.

13. The ring segment of claim 1, wherein the at least one cooling fluid supply passage is entirely located within the panel and is angled in a radially inward direction and toward the leading edge of the panel such that the cooling fluid entering the at least one cooling fluid supply passage is able to approach the inner side of the panel near the leading edge.

14. The ring segment of claim 1, wherein the transitional cooling fluid passages extend generally axially through the panel toward the trailing edge of the panel.

15. A ring segment for a gas turbine engine comprising:

a panel having a leading edge, a trailing edge, a first mating edge, a second mating edge, an outer side, and an inner side, wherein cooling fluid is provided to the outer side and the inner side defines at least a portion of a hot gas flow path through the gas turbine engine;

a cooling system within the panel that receives cooling fluid from the outer side of the panel for cooling the panel, the cooling system comprising:

a plurality of cooling fluid supply passages that receive the cooling fluid from the outer side of the panel and deliver the cooling fluid to a first cooling fluid chamber within the panel, the first cooling fluid chamber extending circumferentially between the first and second mating edges of the panel and being located near the leading edge of the panel;

at least one serpentine cooling passage downstream from the first cooling fluid chamber and receiving the cooling fluid from the outer side of the panel, the cooling fluid providing convective cooling to the panel as it passes through the at least one serpentine cooling passage, wherein the at least one serpentine cooling passage comprises at least two turns of about 180 degrees, the turns being configured such that the cooling fluid passing through the at least one serpentine cooling passage flows generally axially toward the trailing edge, turns about 180 degrees and flows generally axially toward the leading edge, and again turns about 180 degrees and flows generally axially toward the trailing edge;

a plurality of generally axially extending transitional cooling fluid passages that receive the cooling fluid from the first cooling fluid chamber and discharge the cooling fluid toward the at least one serpentine cooling passage; and at least one cooling fluid discharge passage that discharges the cooling fluid from the cooling system.

16. The ring segment of claim 15, wherein the at least one serpentine cooling passage is configured such that axially extending portions thereof are located circumferentially adjacent to each other at substantially the same radial location.

17. The ring segment of claim 16, wherein the at least one serpentine cooling passage comprises a plurality of serpentine cooling passages.

18. The ring segment of claim 17, further comprising a second cooling fluid chamber within the panel, the second cooling fluid chamber extending circumferentially between the first and second mating edges of the panel, wherein the second cooling fluid chamber receives the cooling fluid from the transitional cooling fluid passages and delivers the cooling fluid to the serpentine cooling passages.

19. The ring segment of claim 18, further comprising a third cooling fluid chamber within the panel, the third cooling fluid chamber extending circumferentially between the first and second mating edges of the panel, wherein the third cooling fluid chamber receives the cooling fluid from the serpentine cooling passages and delivers the cooling fluid to the at least one cooling fluid discharge passage.

20. The ring segment of claim 19, wherein the at least one cooling fluid discharge passage comprises a plurality of cooling fluid discharge passages.

* * * * *